US009677779B2

(12) United States Patent
Miglio

(10) Patent No.: US 9,677,779 B2
(45) Date of Patent: Jun. 13, 2017

(54) MODULAR CHILLER UNIT WITH DEDICATED COOLING AND HEATING FLUID CIRCUITS AND SYSTEM COMPRISING A PLURALITY OF SUCH UNITS

(75) Inventor: Ross A. Miglio, Lake Mary, FL (US)

(73) Assignee: CLIMACOOL CORP., Oklahoma City, OK (US)

( * ) Notice: Subject to any disclaimer, the term of this patent is extended or adjusted under 35 U.S.C. 154(b) by 1040 days.

(21) Appl. No.: 13/567,167

(22) Filed: Aug. 6, 2012

(65) Prior Publication Data

US 2012/0297811 A1 Nov. 29, 2012

Related U.S. Application Data

(63) Continuation of application No. 13/089,860, filed on Apr. 19, 2011.

(60) Provisional application No. 61/326,066, filed on Apr. 20, 2010.

(51) Int. Cl.

| | |
|---|---|
| ***F24F 3/06*** | (2006.01) |
| ***F25B 29/00*** | (2006.01) |
| ***F24F 7/00*** | (2006.01) |

(52) U.S. Cl.
CPC ..... *F24F 3/06* (2013.01); *F24F 7/00* (2013.01); *F25B 29/003* (2013.01); *F25B 2400/06* (2013.01); *F25B 2400/21* (2013.01)

(58) Field of Classification Search
USPC ..... 62/238.7, 298, 324.1, 324.6
See application file for complete search history.

(56) References Cited

U.S. PATENT DOCUMENTS

| | | | | |
|---|---|---|---|---|
| 4,454,725 | A * | 6/1984 | Cann | 62/117 |
| 2010/0108290 | A1* | 5/2010 | Maxwell | 165/62 |
| 2010/0132390 | A1* | 6/2010 | Platt et al. | 62/238.7 |

* cited by examiner

*Primary Examiner* — Christopher R Zerphey
(74) *Attorney, Agent, or Firm* — Mary M. Lee

(57) ABSTRACT

A modular heating and cooling unit comprising an independent set of headers for each of the heating and cooling loads and the source. A bank of these modular units provides a system that is capable of incremental simultaneous heating and cooling and redundancy. Valves in the internal piping of the unit eliminate the need for valves in the headers between units. This substantially reduces the overall footprint of the unit. Because of the parallel flow between the heat exchangers and the heating and cooling load, the modules can be operated in cooling mode and heating mode in any order.

22 Claims, 12 Drawing Sheets

MODULAR CHILLER UNIT WITH DEDICATED COOLING AND HEATING FLUID CIRCUITS AND SYSTEM COMPRISING A PLURALITY OF SUCH UNITS

CROSS-REFERENCE TO RELATED APPLICATION(S)

This application is a continuation application of co-pending U.S. patent application Ser. No. 13/089,860 entitled "Modular Chiller Unit with Dedicated Cooling and Heating Fluid Circuits and System Comprising a Plurality of Such Units," filed Apr. 19, 2011, which application claims the benefit of the filing date of U.S. Provisional Patent Application No. 61/326,066 filed Apr. 20, 2010, entitled "Modular Chiller Unit with Dedicated Cooling and Heating Fluid Circuits and System Comprising a Plurality of Such Units," and the contents of these prior applications are incorporated herein by reference.

FIELD OF THE INVENTION

The present invention relates generally to heating and cooling systems and more specifically to modular chiller systems that can provide simultaneous heating and cooling.

DETAILED DESCRIPTION OF THE PREFERRED EMBODIMENT(S)

Conventional modular heating and cooling systems typically include a bank of modular units, each with its own heat exchangers, headers, and piping. A single set of inlet and outlet headers supply both heating and cooling loads. Prior art heating and cooling systems have provided simultaneous heating and cooling in one system by interposing isolation valves between each of the modular units in the system. By controlling which set of isolation valves are closed, the number of units cooling and heating can be varied. This valve system, in effect, creates a moveable or "virtual" end cap system dividing the units that are in the cooling mode from those that are in the heating mode. While simultaneous heating and cooling is advantageous, the use of isolation valves between each module increases the footprint of the overall system.

Figure 7:
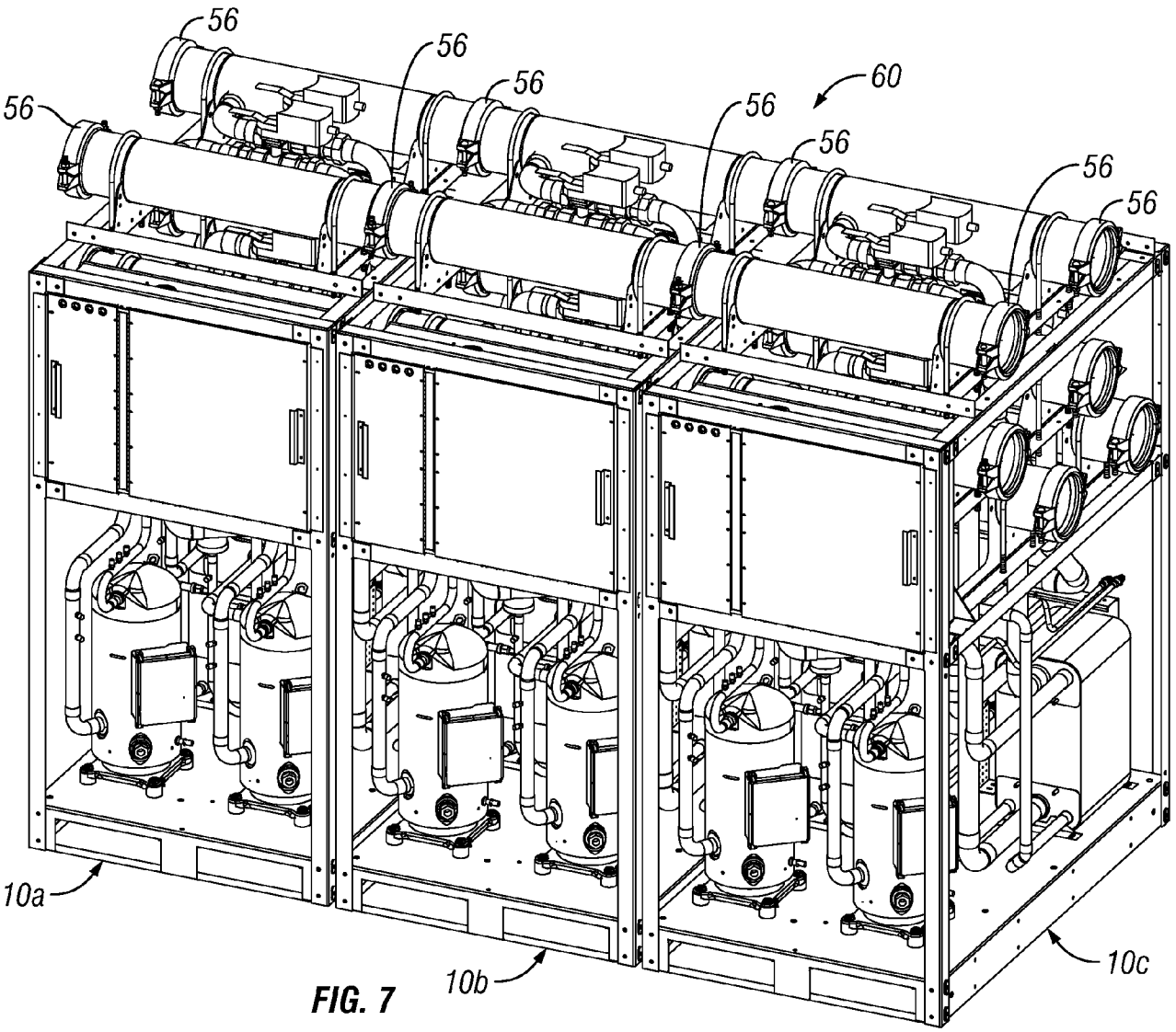
FIG. 7 is a right front perspective view of a bank of three interconnected modular chiller units, as shown in FIG. 2, for use in a system in accordance with the first preferred embodiment of the present invention.
Figure 8:
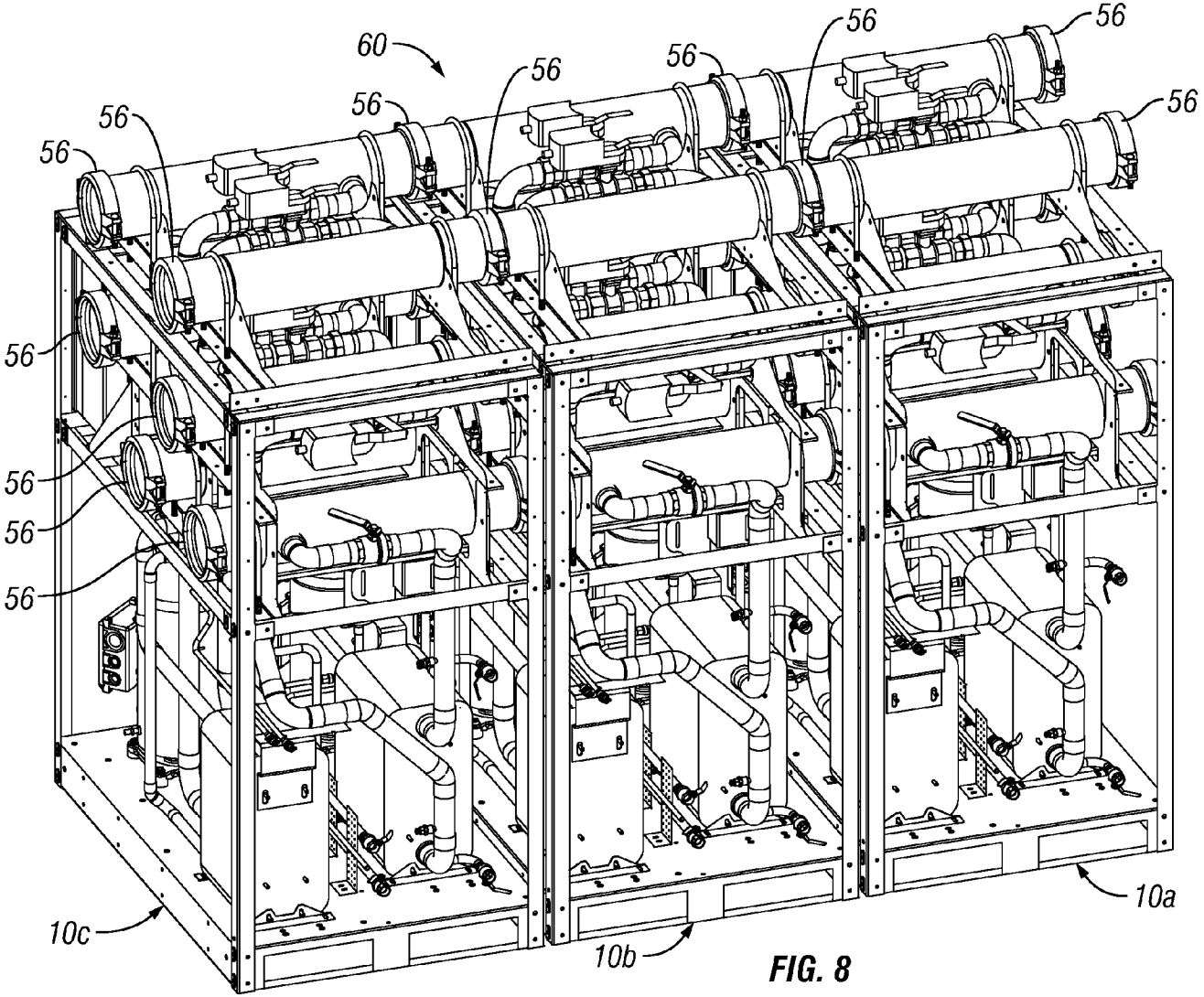
FIG. 8 is a right rear perspective view of the bank of modular chiller units shown in FIG. 7.

The present invention provides a system that can heat and cool simultaneously without inter-module isolation valves. As shown in FIGS. 7 and 8, this substantially reduces the space required between modules in a system and thus reduces the total space required. It also simplifies the overall design, the controls, and the installation of systems.

The preferred system incorporates a plurality of individual modular units each of which has two sets of headers, one for the cooling load and one for the heating load. (The term "chiller," as used herein, refers to a unit that may include both heating and cooling.) Where the system includes a water-source heat exchanger, a third set of headers is included to circulate water between a water source heat exchanger in the module and an external water tower or other water source.

The use of two sets of dedicated heating and cooling headers eliminates the need for header valves or valve modules between units in a system. Instead a valve is provided in each of the pipes that connects the heat exchanger to a header. Eliminating the inter-module valves has several advantages. The overall footprint of the module and of a bank of modules is significantly reduced. There is a reduced risk that a header valve failure will result in mixing of the hot and cold water streams. Unwanted energy transfer across the large inter-module valves is eliminated. The internal valves also allow the flow path of the water through the heat exchanger to be reversed when switching between the cooling mode and the heating mode. This ensures that a cross counterflow configuration is maintained in both modes, and thus maximizes efficiency of the heat transfer.

When the unit is in cooling mode, the valves to the cooling headers are open and the valves to the heating headers are closed. When the unit is in heating mode, the valves to the heating headers are open and the cooling headers are closed. Although motorized valves are shown and preferred, the present invention includes the use of various types of valves, including but not limited to manual, hydraulic, pneumatic, electric, or any combination of these.

Figure 1:
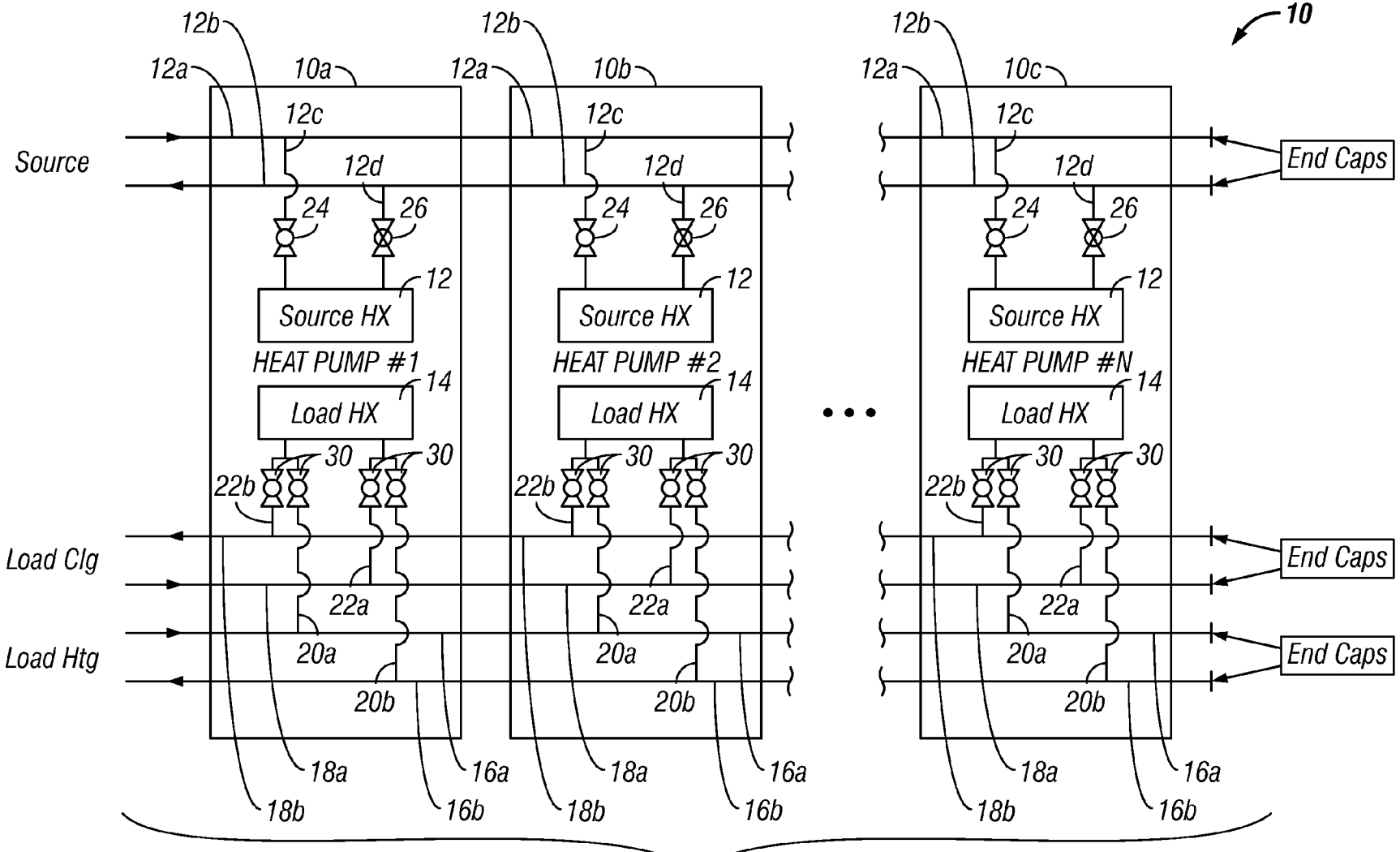
FIG. 1 is a schematic drawing of the fluid circuit of a system constructed in accordance with a first preferred embodiment of the present invention.

Turning now to the drawings in general and to FIG. 1 in particular, shown therein is a system constructed in accordance with a preferred embodiment of the present invention and designated generally by the reference number 10. The system 10 comprises a bank of a number "N" of interconnected modules. However, more or fewer units may be used. In FIG. 1, three of the modules in the bank are identified as 10*a*, 10*b* and 10*c*.

The system 10 is designed to use water-source heat exchangers. Thus, each unit 10*a*, 10*b*, and 10*c* comprises a source heat exchanger 12 ("Source HX") and a pair of source headers 12*a* and 12*b*, inlet and outlet, respectively. Valved connecting pipes 12*c* and 12*d* connect the heat exchanger 12 to the headers 12*a* and 12*b*. In this way, circulation of water (or other heat exchange fluid) is provided between the Source HX 12 and the Source.

The "Source" is typically a geothermal well field, cooling tower, pond, lake or other source of water or a water/glycol mixture. The Source HX 12 operates alternately in the heating (condenser) or cooling (evaporator) mode depending on the demands of the structure served by the system 10.

Alternately, an embodiment is contemplated for use in an air cooled heat pump chiller, in which the source would be ambient air. In such an embodiment, the first heat exchanger would be a refrigerant-to-air heat exchanger, and the valved connecting pipes and headers to the Source would be omitted. In other respects, the system would be similar.

Each of the modular heating and cooling units 10*a*, 10*b*, and 10*c* includes a load heat exchanger 14 ("Load HX") for heating or cooling the fluid going to and from the heating load ("Load Htg") and the cooling load ("Load Clg"), respectively. One pair of headers 16*a* and 16*b* provide inlet and outlet flows to the heating load, and a separate and fluidly independent set of headers 18*a* and 18*b* provide inlet and outlet flows to the cooling load.

Valved connecting pipes 20*a* and 20*b* fluidly connect the load heat exchanger 14 to the heating load headers 16*a* and 16*b*. Similarly, valved connecting pipes 22*a* and 22*b* fluidly connect the load heat exchanger 14 to the cool load headers 18*a* and 18*b*. When a plurality of the modular units is used in a bank of units, as shown and described herein with reference to the preferred embodiment, the units preferably will include the headers by which the units are interconnected. However, there may be instances when only a single unit is employed. In such a case, the headers may be omitted and the valved connecting pipes may be connected directly to the source and heating and cooling load circuits.

Thus, the two sets of valved connecting pipes, and headers when they are included, create two separate parallel fluid circuits, one dedicated to the cooling load and one dedicated to the heating load. That is, each fluid circuit moves fluid in a single direction serving only one load (heating or cooling) and is either open or closed. The second heat exchanger will function alternately as a condenser or evaporator, depending on the system settings.

Now it will also be apparent that the valved connecting pipes ensure that in both the heating and cooling modes a cross counterflow is maintained; in the cooling mode, water moves from right to left through the heat exchanger as viewed in FIG. 1, and in the heating mode, water moves from left to right. That means that, in the cooling mode, the chilled water in the cooling load circuit leaves the heat exchanger 14 (in the connecting pipe 22*b*) on the coldest side of the refrigerant circuit. Similarly, in the heating mode, the heated water returning to the heating load (in connecting pipe 20*b*) leaves the heat exchanger on the hottest side of the refrigerant circuit. Thus, the heat transfer in the heat exchanger is maximized in both modes of operation.

One motorized valve 24 connects the Source HX 12 to the source inlet header 12*a*, and one manual valve 26 connects the Source HX to the source outlet header 12*b*. Motorized valves, all designated generally by the reference number 30, on each of the valved connecting pipes 20*a*, 20*b*, 22*a*, and 22*b* control whether the respective unit 10*a*, 10*b*, or 10*c* is operating in the cooling or heating mode. In this embodiment, there are four (4) motorized valves 30 in each of the modular units 10*a*, 10*b*, and 10*c*: two (2) in parallel from the load heat exchanger return pipes 16*a* and 18*a*, and two (2) in parallel from the load heat exchanger supply 16*b* and 18*b*. The system 10 may also include electronic controls and connections (not shown) for controlling the operation of each of the units.

With reference now to FIGS. 2-6, the preferred structure of a single module or unit will be described in more detail. As the units 10*a*-10*c* preferably are similarly constructed, only the unit 10*a* will described. The components of the unit 10*a* are supported on the frame 36. The frame 36 may take many forms. Preferably, the frame 36 is an open structure to allow access from all sides and the top. To that end, an ideal structure comprises a floor 38, four vertical members 40*a*, 40*b*, 40*c* and 40*d* connected at the top by four horizontal members 42*a*, 42*b*, 42*c*, and 42*d*, which form a top 44.

The two heat exchangers 12 and 14 and at least and preferably two compressors 48 and 50 may be fixed to the floor 38 on the lowermost level of the frame. Most preferably, the heat exchangers 12 and 14 are supported near the rear 52 of the frame, and the compressors 48 and 50 may then be placed near the front 54 of the frame 36. In this way, these components are accessible for service and repair without having to remove them from the module and without having to remove the module from the assembled system 10.

Each of the headers 12*a*, 12*b*, 16*a*, 16*b*, 18*a*, and 18*b* is equipped with a coupling of some sort by which it is connectable to the end of the corresponding header on an adjacent unit. In the preferred embodiment shown, grooved couplings are used. These couplings are designated herein by the reference number 56. However, any suitable type of coupling may be employed.

Figure 2:
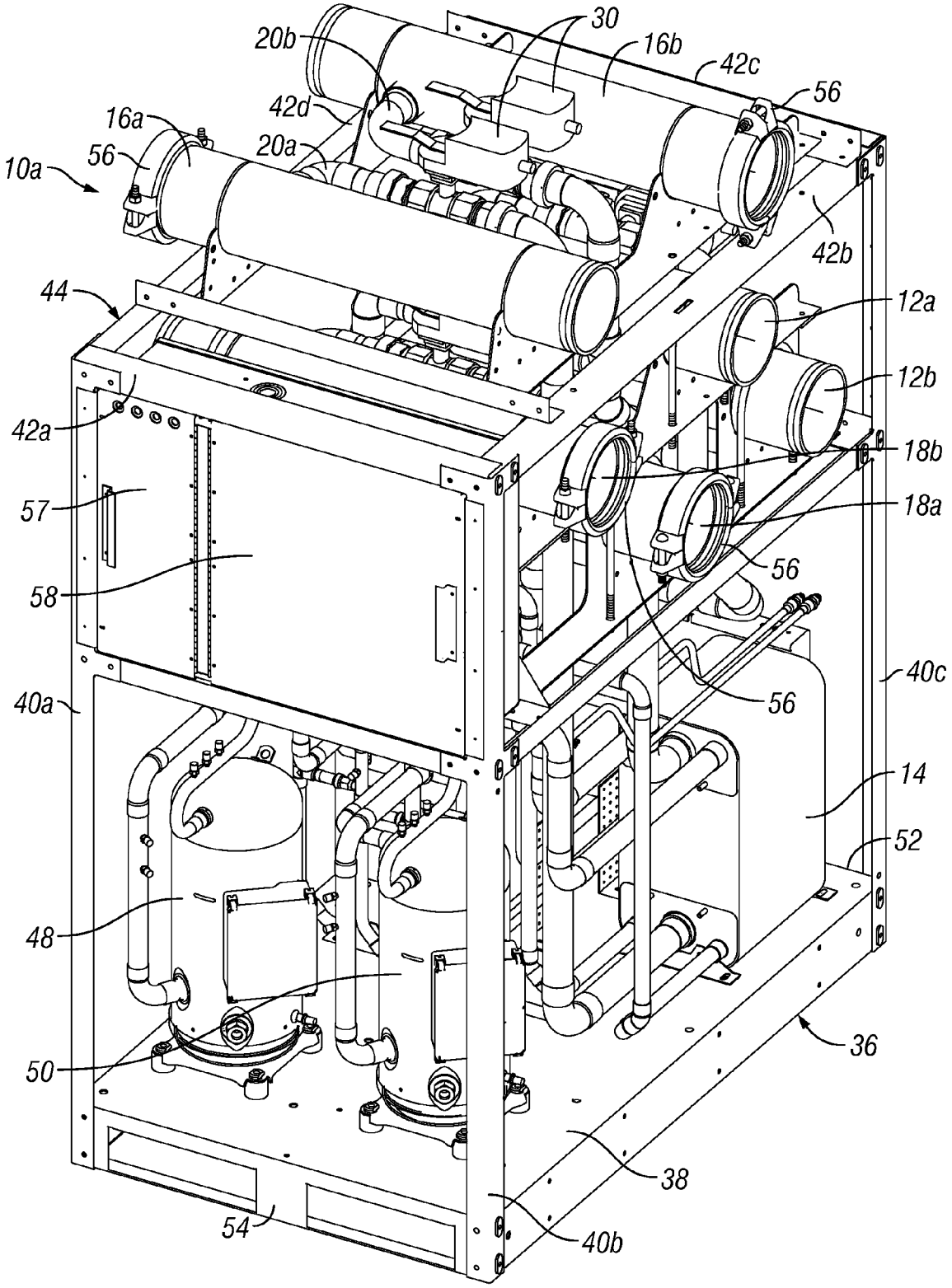
FIG. 2 is a right front perspective view of the modular chiller unit shown in FIG. 2.
Figure 3:
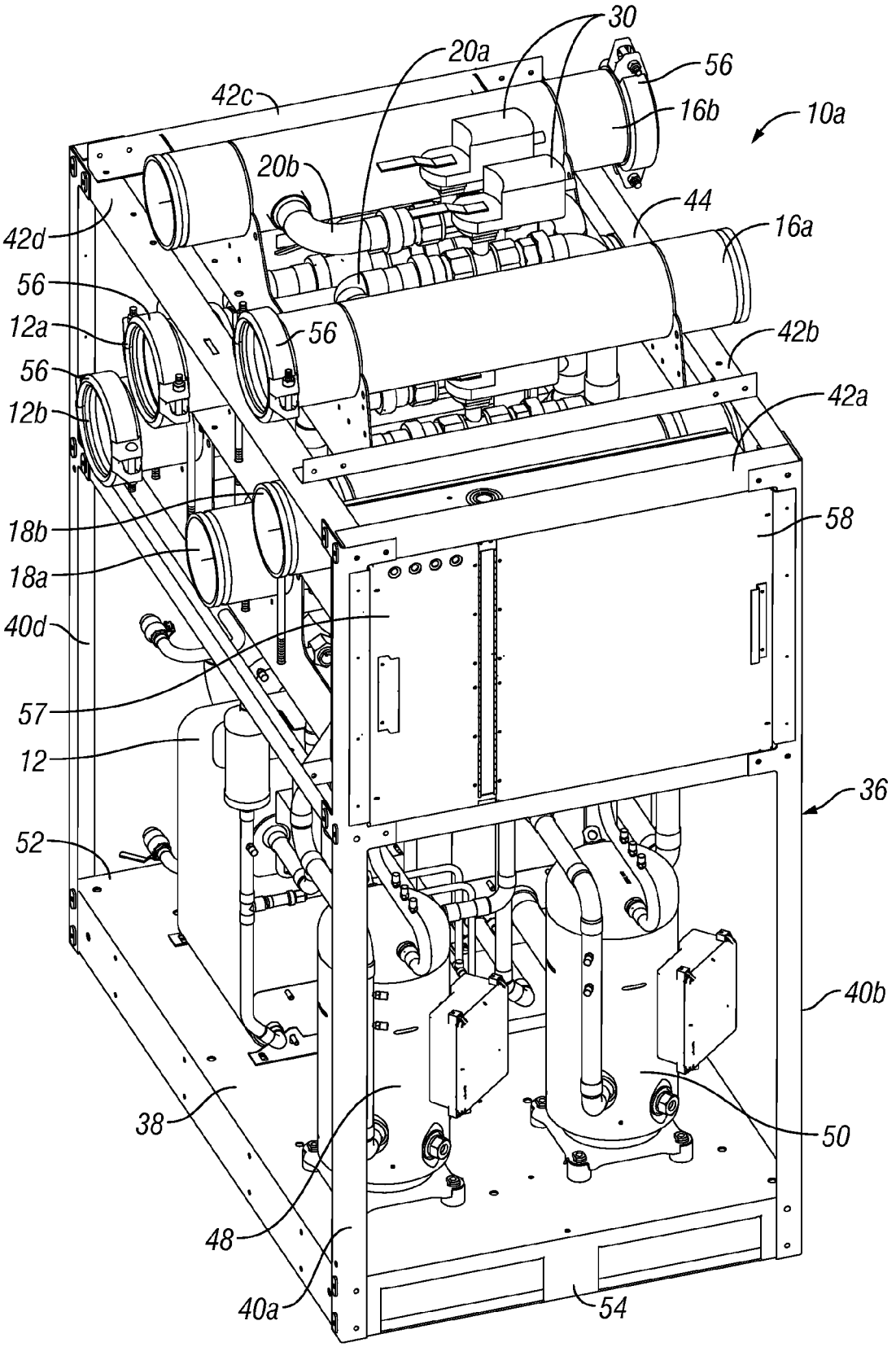
FIG. 3 is a left front perspective view of the modular chiller unit shown in FIG. 2.
Figure 4:
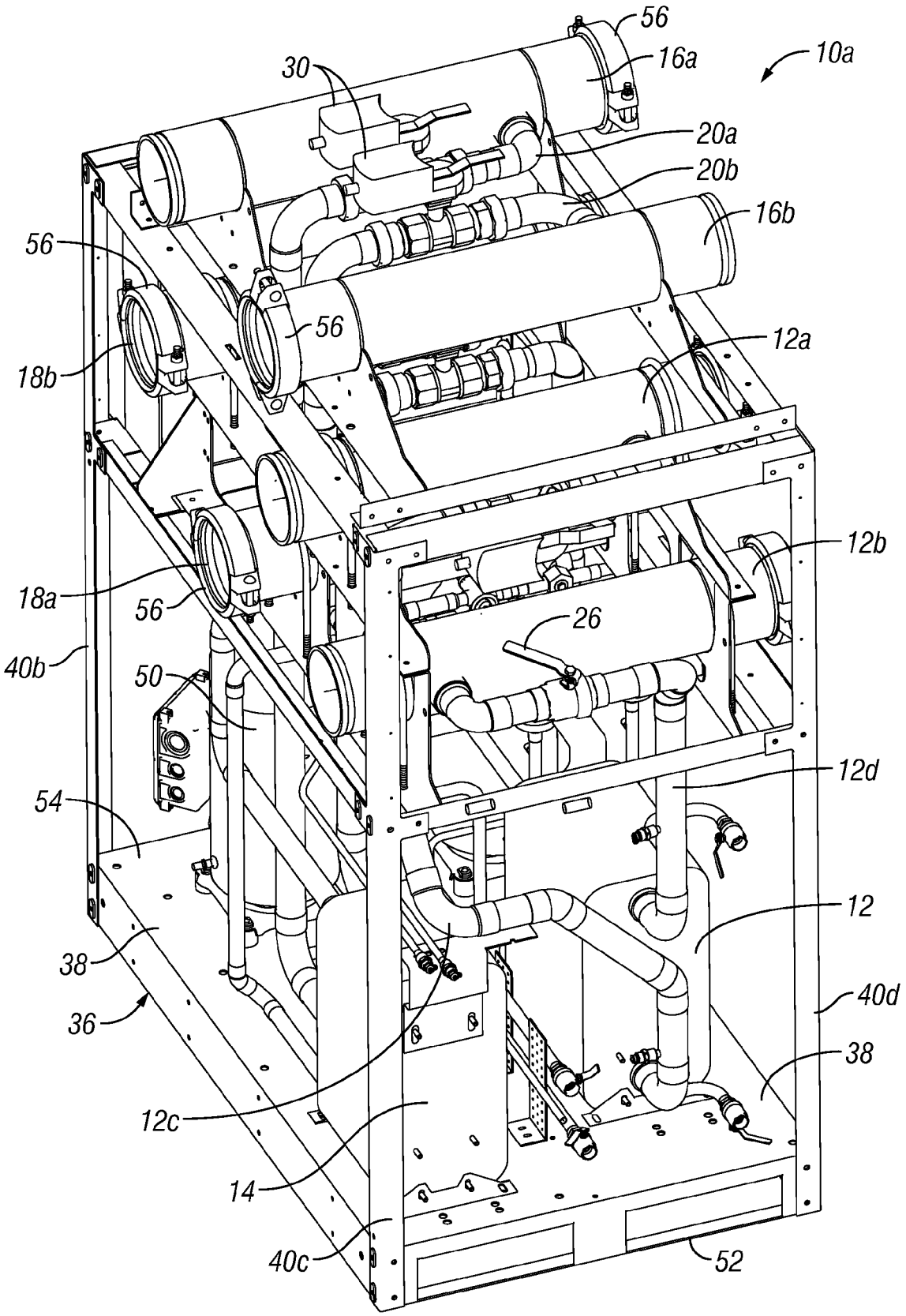
FIG. 4 is a right rear perspective view of the modular chiller unit shown in FIG. 2.
Figure 5:
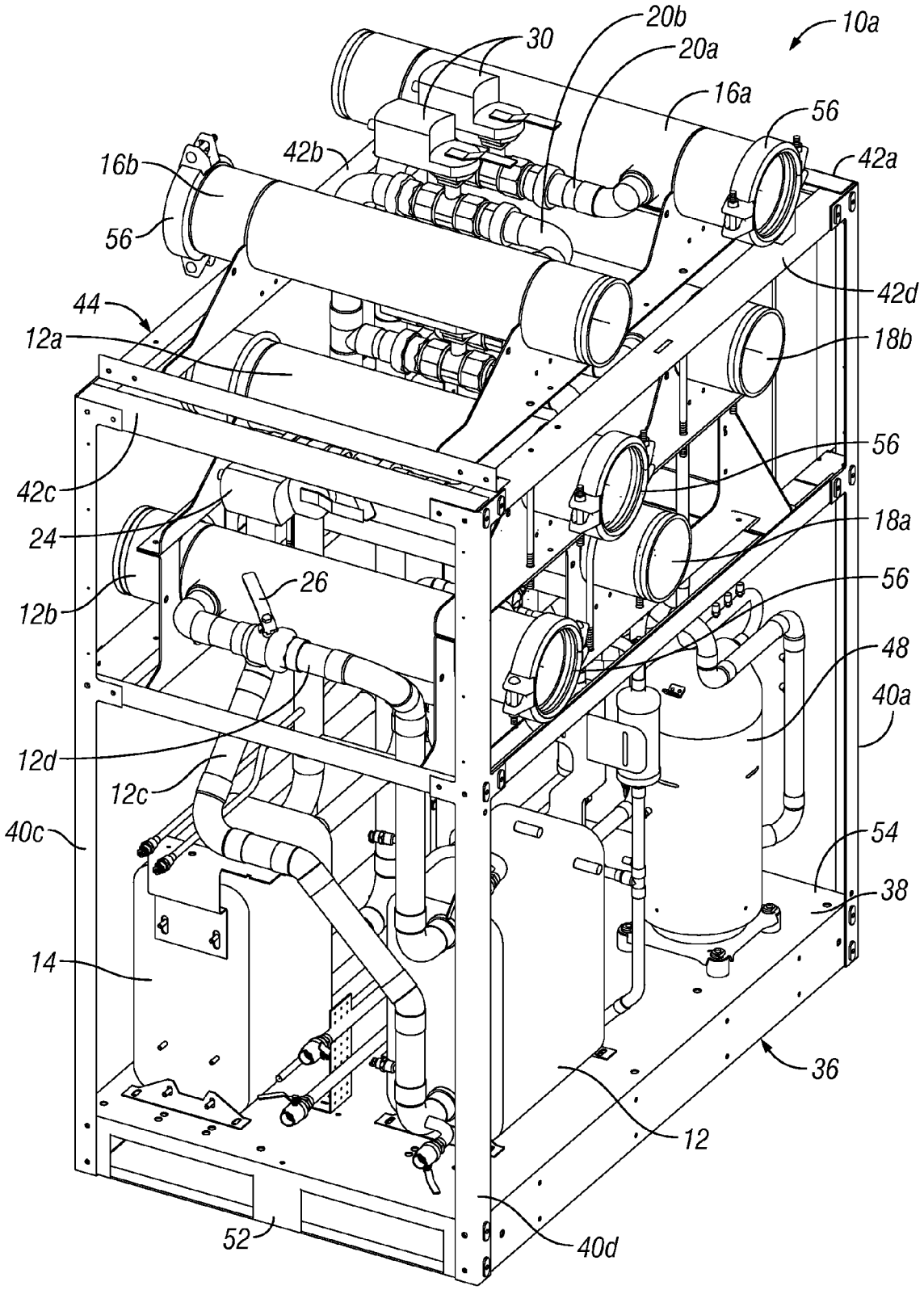
FIG. 5 is a right rear perspective view of the modular chiller unit shown in FIG. 2.
Figure 6:
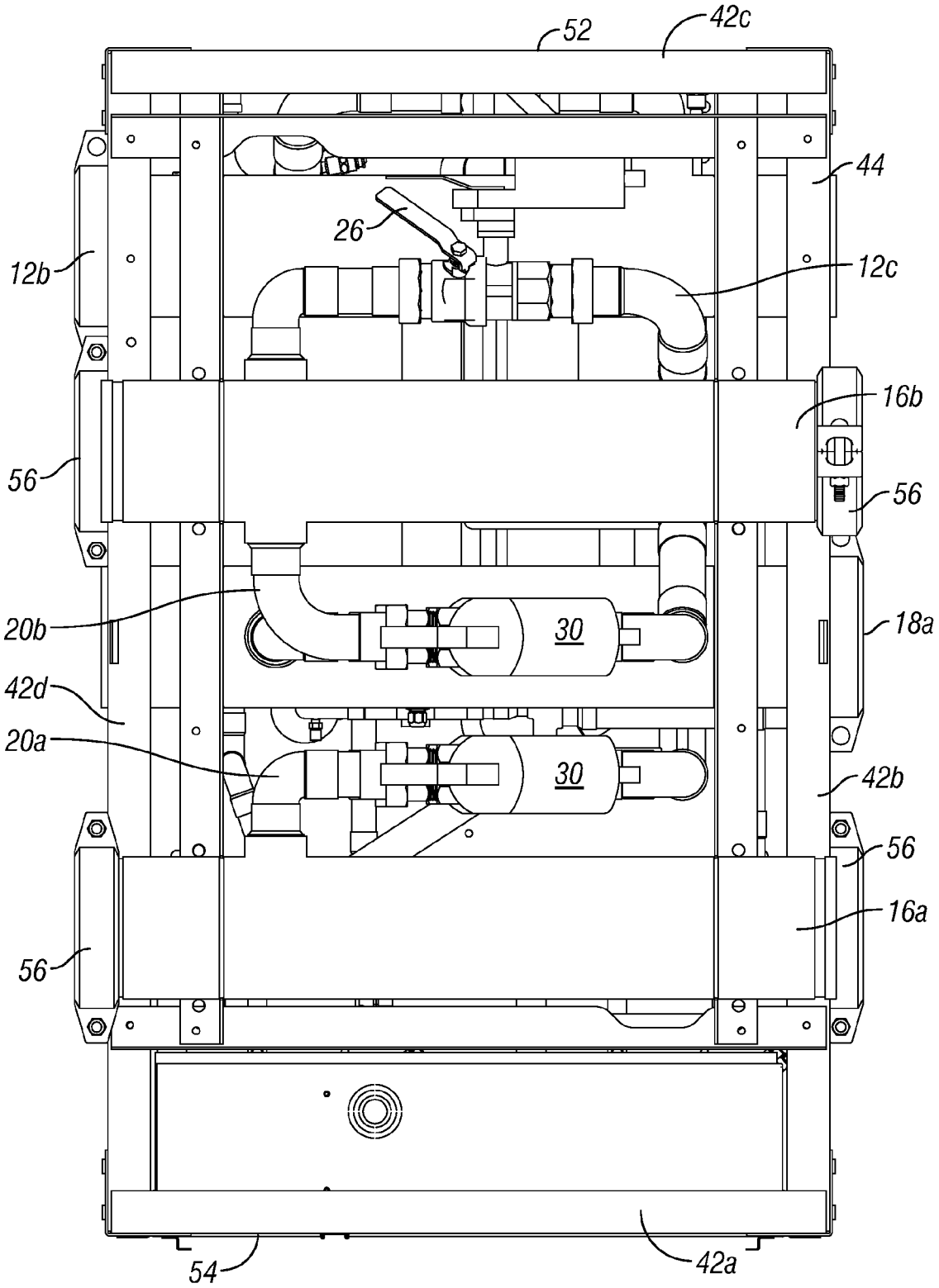
FIG. 6 is a plan view of the modular chiller unit shown in FIG. 2.

As seen in FIGS. 2 and 3, the module 10*a* preferably includes an electrical box 57 and a control panel 58. These are conveniently positioned on front 54 of the unit 10*a* for easy access.

Turning now to FIGS. 7 and 8, a bank 60 of three interconnected modules 10*a*, 10*b* and 10*c* is shown. As indicated previously, the bank 60 may include more or fewer modules, as indicated schematically in FIG. 1. The units 10*a*, 10*b* and 10*c* are interconnected by the grooved couplings 56. One end of each header series is capped off with an end cap (FIG. 1), and the other end is connected to the fluid conduits in the structure in a known manner. It should be noted that one advantage provided by the system 10 of the present invention is the flexibility in how the system is connected. That is, the building's heating and cooling system can be connected on either end of the bank of units or both heating and cooling can be connected on the same end.

FIGS. 7 and 8 illustrate the compactness of the modules 10*a*, 10*b*, and 10*c*. Additionally, it will appreciated from these views how the elimination of isolation valves between units reduces the over footprint of each unit and of the bank of units.

Now it will be apparent that the bank of modules 10 provides a simultaneous heating and cooling system where any of the individual modules 10*a*, 10*b*, and 10*c*, can provide heating or cooling capacity to simultaneously satisfy required heating and cooling demands and without the use of interconnecting module/header valves. Also, because of the independent fluid circuits, the modules can be operated in any order. For example, units 10*a* and 10*c* can be operated in the heating mode while unit 10*b* runs in the cooling mode.

Having described the overall system design, the operation will be explained. The system controller (not shown) identifies which modules are to operate in the cooling mode and which are to operate in the heating mode to match changing heating and cooling load demands in the building (not shown). As indicated, the working fluid from the loads is circulated in parallel to the units and, thus, which units are operating and in what order they are used can be set by the programmed control system. This prevents over use of a single module because of its location in the bank.

Once the system is programmed as desired, valves are operated to direct fluid as required. In the heat pump/cooling mode, the designated modules are indexed to cooling, based on cooling demand. Motorized valves to the source inlet and source outlet 12*a* and 12*b* are opened. Motorized valves to the cooling inlet header 18*a* and cooling outlet header 18*b* are opened, and the motorized valves to the heating inlet header 16*a* and heating outlet header 16*b* are closed.

In the heat pump/heating mode, modules designated for heating mode are indexed to heating, based on heating demand. Motorized valves to the source inlet header 12*a* and source outlet header 12*b* are opened. Motorized valves to the heating inlet header 16*a* and heating outlet header 16*b* are opened. Motorized valves to the cooling inlet header 18*a* and cooling outlet header 18*b* are closed.

The motorized valves may be on/off valves or proportional valves. It will be appreciated that proportional valves offer an advantage in that flow rate of the water can be controlled, in addition to changing the direction of flow through the heat exchanger. This allows the system to adjust the flow to regulate the refrigerant pressure and leaving water temperature. Additionally, the proportional valves can act as refrigerant pressure control valves, which limit flow on cold source water start-up in the cooling mode and limit flow on the evaporator in the cooling mode when the evaporator leaving water temperature is above the compressor application limits.

Figure 9:
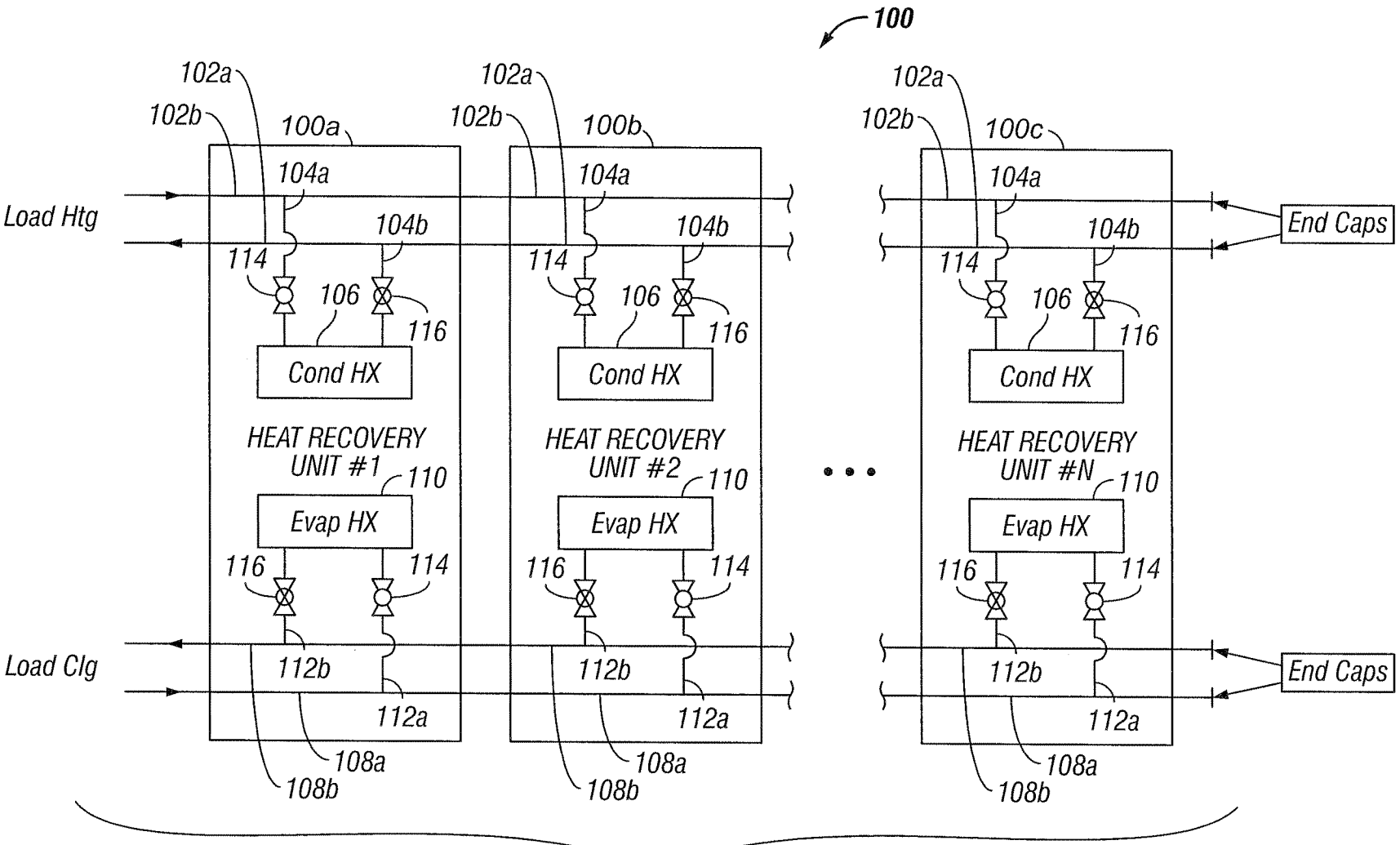
FIG. 9 is a schematic drawing of a bank of auxiliary modules that can serve as dedicated heating or dedicated cooling units in a system of the present invention.

One of the advantages of units designed in accordance with the embodiment of FIGS. 1-8 is that they can function alternately in the heating or cooling mode. In some applications it may be desirable to combine the multi-function units with simplified units that can be dedicated exclusively to heating and cooling. FIG. 9 shows a system 100 comprising such units.

The source headers (12*a* and 12*b* in FIGS. 2-8) have been eliminated. The system 100 comprises one or more modules, such as the modules 100*a*, 100*b*, and 100*c*. The hot water headers 102*a* and 102*b* are connected by valve connecting pipes 104*a* and 104*b* to the condenser 106 (the source heat exchanger in the embodiment of FIGS. 1-8). The cold water headers 108*a* and 108*b* are connected to the evaporator 110 by valved connecting pipes 112*a* and 112*b*. Motorized valves 114 may be used on the inlet pipes 104*a* and 112*a*, and manual valves may be used on the outlet pipes 104*b* and 112*b*.

Figure 10:
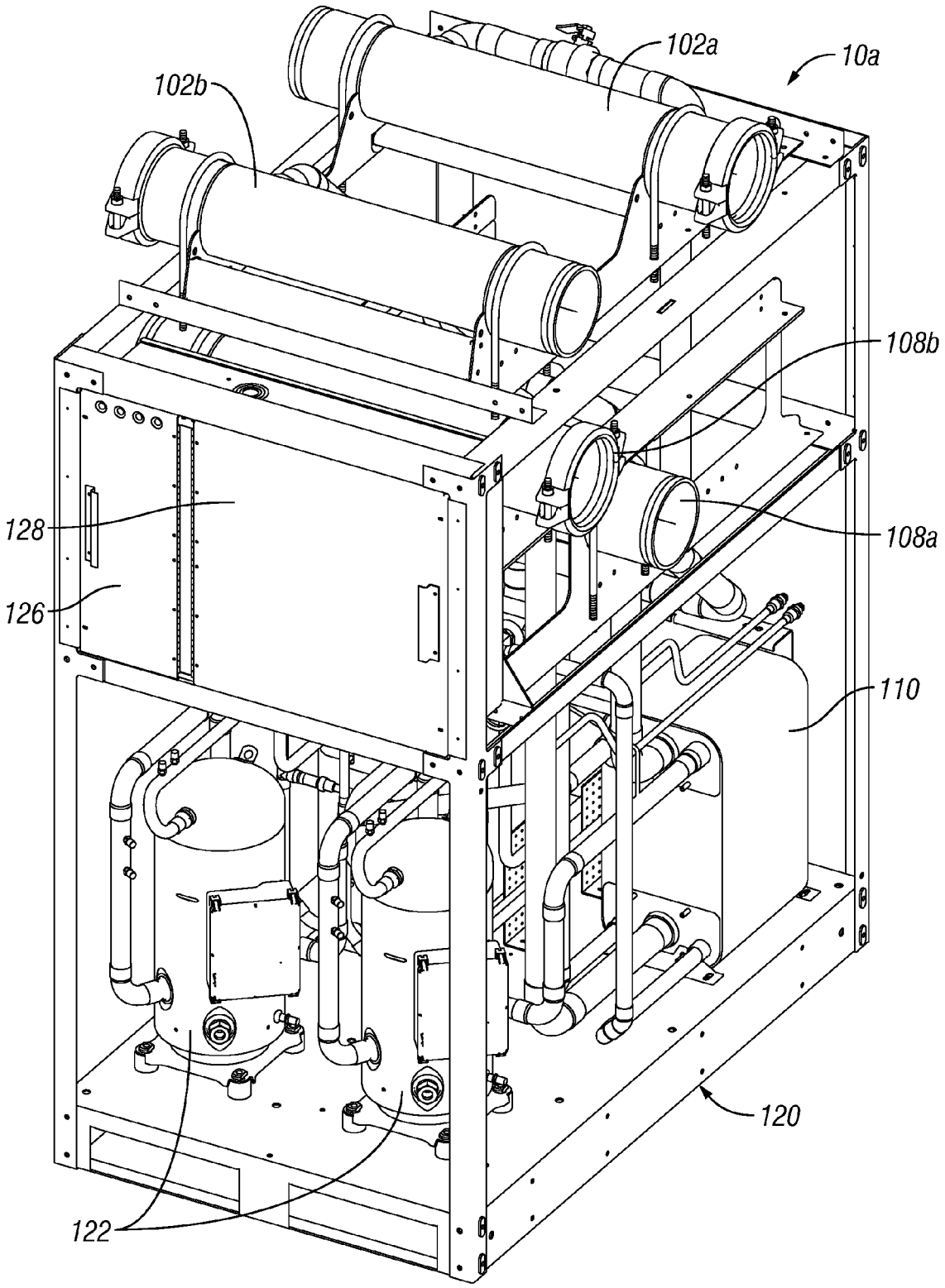
FIG. 10 is a right front perspective view of one of the modular chiller units shown schematically in FIG. 9.
Figure 11:
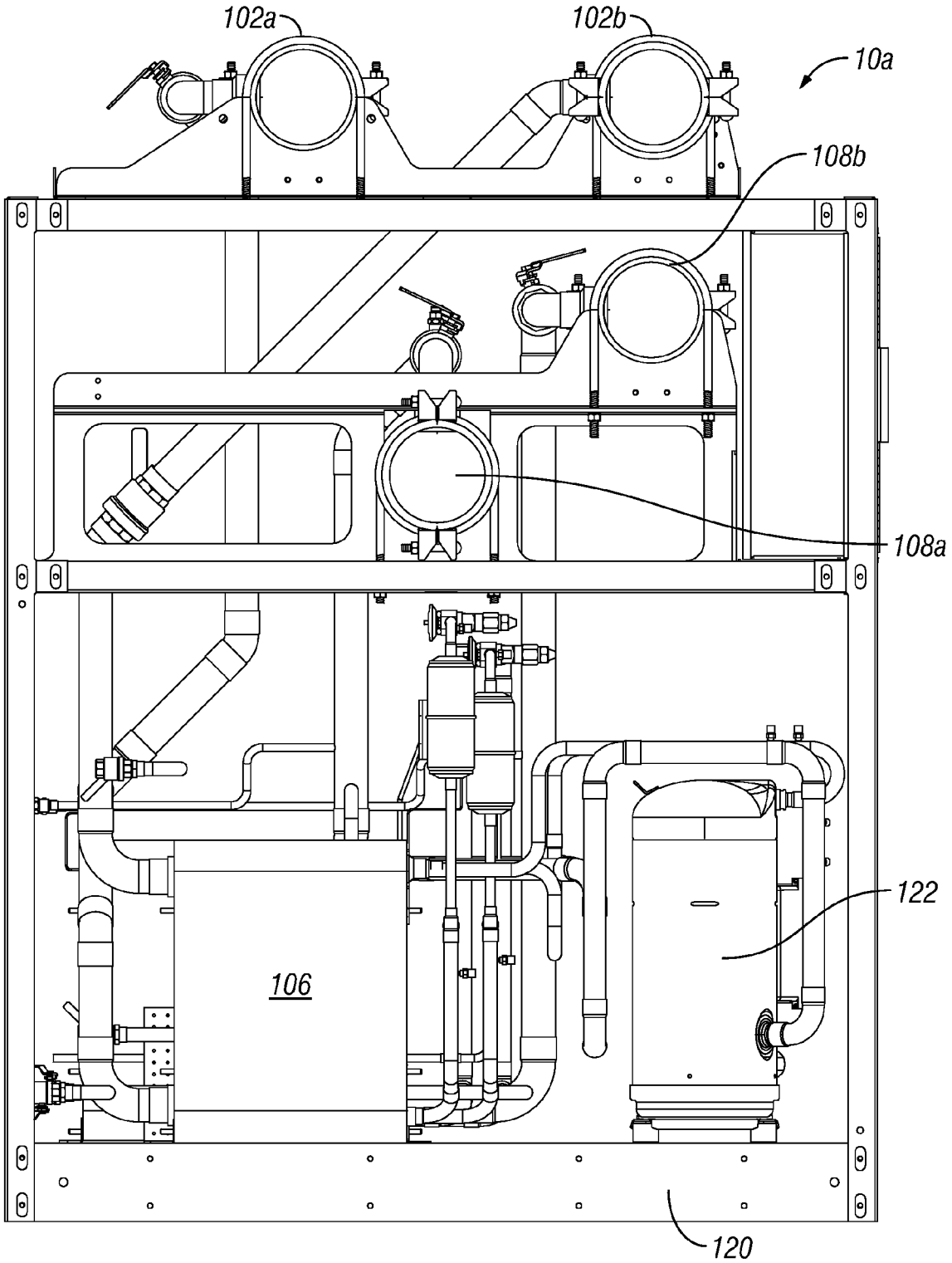
FIG. 11 is a left side elevational view of the unit of FIG. 10.

A module, such as the module 100*a* shown in FIGS. 10 and 11, built for the system 100 would be structured as in the previous embodiment, except that the source headers and piping are eliminated. The headers 102*a* and 102*b* and 108*a* and 108*b*, with the heat exchangers 106 and 110, are supported on a frame 120, along with one or more compressors 122. Also included are an electrical panel 126 and a control box 128.

This type of unit could be useful to supplement the system 10 previously described. As these modules are less expensive, they could be used to provide units that are dedicated to the heating or cooling side of larger systems where there known continuous minimum demands for cooling or heating or both.

Figure 12:
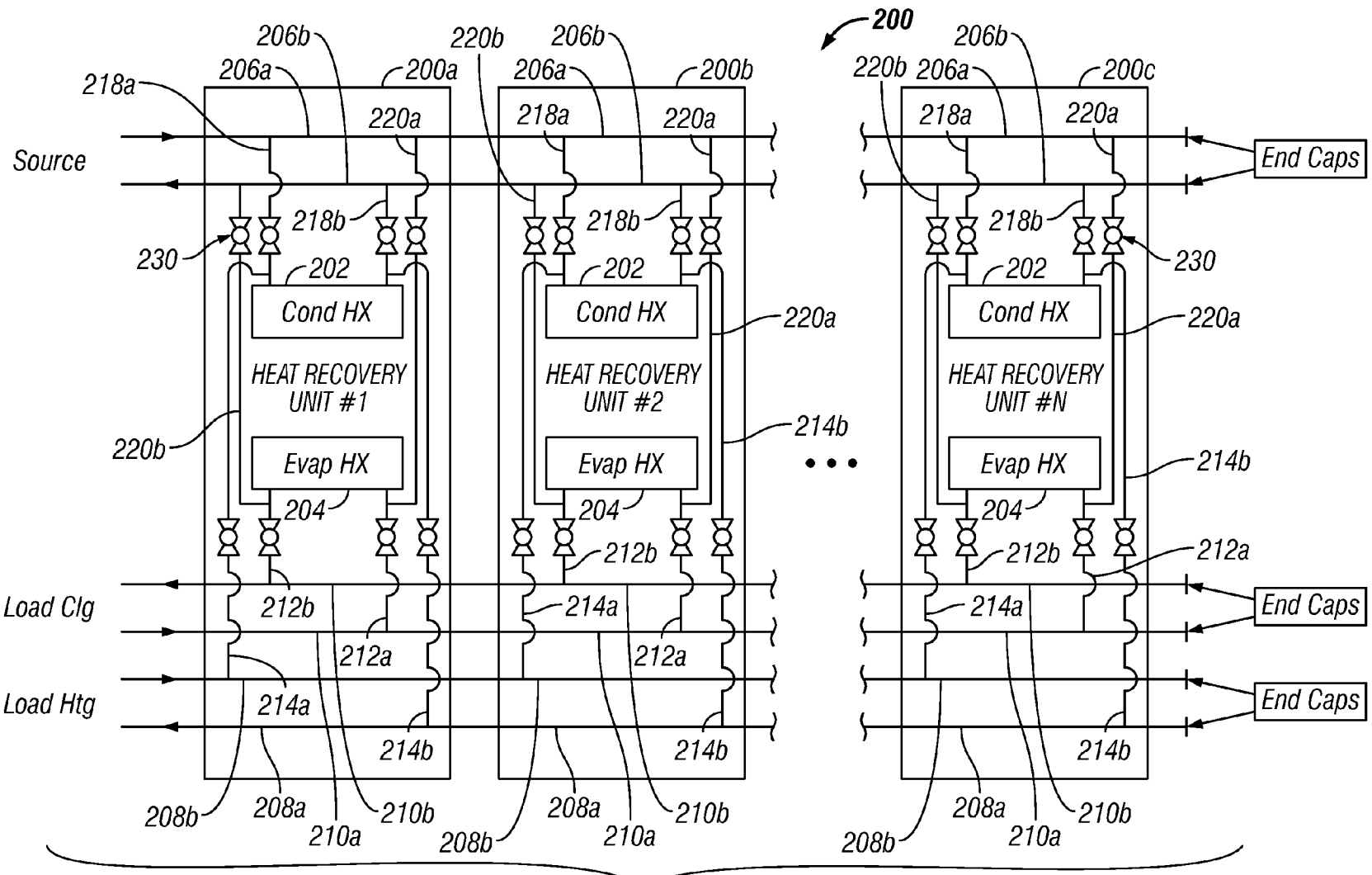
FIG. 12 is a schematic drawing of the fluid circuit of a system constructed in accordance with a second preferred embodiment of the present invention.

Turning now to FIG. 12, another preferred embodiment of the present invention will be described. FIG. 12 shows a schematic of a system 200 in which the individual modules 200*a*, 200*b* and 200*c* are heat recovery type modules instead of heat pumps. The source is neutral to provide a range of temperatures between the cooling and heating set points. For example, the source may provide a range of between about 50-70 degrees to absorb or release heat, as needed.

The first heat exchanger 202 serves exclusively as a condenser in the heating mode, and the second heat exchanger 204 serves exclusively as an evaporator in the cooling mode. However, due to additional valved connecting pipes, each of the units can operate alternately in the cooling or heating mode. Yet, as in the embodiment of FIG. 1, a cross counterflow is maintained in both the heating load circuit and cool load circuit. Additionally, one unit can provide equal or unequal amounts of both heating and cooling.

As in the previous embodiment of FIG. 1-8, there are 6 headers: headers 206*a* and 206*b* provide flow to and from the source; headers 208*a* and 208*b* connect to the heating load; and, headers 210*a* and 210*b* connect to the cooling load. Although the units 200*a*, 200*b*, and 200*c* are shown with headers, it will be understood that, where a unit is used alone, headers may be omitted.

Valved connecting pipes 212*a* and 212*b* connect the cooling load ("Load Clg") to the evaporator 204, and valved connecting pipes 214*a* and 214*b* connect the heating load ("Load Htg") to the condenser 202. In addition, the condenser 202 is connected to the source headers 206*a* and 206*b* by valved connecting pipes 218*a* and 218*b*, and the evaporator 204 is connected to the source headers 0206*a* and 206*b* by valved connecting pipes 220*a* and 220*b*. The valves, which are designated collectively at 230, may all be motorized valves, or alternately may be proportional or modulating valves.

A control system (not shown) will automatically operate the valves 230 to switch evaporator flow from the cooling loop to the source loop once the cooling load has been satisfied. In this way, the system is then able to meet the required heating load. Similarly, once the heating load is satisfied, the control system will automatically switch condenser flow from the heating loop to the source loop.

In the cooling-only mode, when there is no heating load, the valves 230 in the connecting pipes 212*a* and 212*b* between the cooling headers 210*a* and 210*b* and the evaporator 204 are open, as are the valves in the connecting pipes 218*a* and 218*b* between the condenser 202 and source headers 206*a* and 206*b*. The other valves are closed. Thus, fluid flows between the evaporator 204 and cooling load, and the excess heat from the condenser 202 is carried to the source.

In the heating-only mode, when there is no cooling load, the valves 230 in the connecting pipes 214*a* and 214*b* and the condenser 202 are open to the headers 208*a* and 208*b*, and so are the valves in the connecting pipes 220*a* and 220*b* between evaporator 204 and the source headers 206*a* and 206*b*. The remaining valves are closed. Thus, fluid flows between the condenser 202 and the heating load, and heat from the source is carried to the evaporator 204.

When the cooling and heating loads are balanced, the valves 230 in the connecting pipes 214*a* and 214*b* and the condenser 202 are open to the heating load headers 208*a* and 208*b*, and the valves 230 in the connecting pipes 212*a* and 212*b* between the cooling headers 210*a* and 210*b* and the evaporator 204 are also open. The connecting pipes 218*a* and 218*b* and 220*a* and 220*b* to the source headers 206*a* and 206*b* are closed. Because the heating and cooling loads are balanced, neither the evaporator nor the condenser requires a source (heat sink or heat source).

Further versatility is provided in the system 200 by employing modulating or proportional valves. This would permit each module to provide heating and cooling simultaneously but to unequal heating and cooling loads. The dominant load can be met (cooling or heating) while the opposite load can be a mixture of load/source or partial heat sink/source operation, to maintain required operational limits (temperatures or pressures).

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions. The description and drawings of the specific embodiments herein do not point out what an infringement of this patent would be, but rather provide an example of how to use and make the invention.

What is claimed is:

1. A heating and cooling module for use with a source to supply heating and cooling loads in a building, the module comprising:

a frame;

a first heat exchanger mounted on the frame;

a second heat exchanger mounted on the frame;

at least one compressor mounted on the frame;

a first pair of valved connecting pipes for conducting fluid between the heating load and one of the first and second heat exchangers;

a second pair of valved connecting pipes for conducting fluid between the cooling load and one of the first and second heat exchangers; and a third pair of valved connecting pipes for conducting fluid between the source and one of the first and second heat exchangers.

2. The heating and cooling module of claim 1 wherein the first and second pairs of valved connecting pipes to the cooling load and the heating load are configured to conduct fluid to and from the second heat exchanger and wherein the third pair of valved connecting pipes to the source conduct fluid to and from the first heat exchanger.

3. The heating and cooling module of claim 2 further comprising a first pair of inlet and outlet headers for connecting the first pair of valved connecting pipes to the heating load, a second pair of inlet and outlet headers for connecting the second pair of valved connecting pipes to the cooling load, and a third set of inlet and outlet headers for connecting the third pair of valved connecting pipes to the source.

4. A bank of modules comprising a plurality of heating and cooling modules as defined in claim 3, and wherein the headers in each module are connected end-to-end with corresponding headers in at least one adjacent module in the plurality of modules.

5. An air conditioning system for a structure, the system comprising the bank of modules defined in claim 4.

6. The heating and cooling module of claim 2 wherein each of the first, second and third pairs of valved connecting pipes comprises a pipe and a valve.

7. The heating and cooling module of claim 3 wherein each of the headers comprises a coupling for connecting to a header on an adjacent unit.

8. The heating and cooling module of claim 1 wherein the first heat exchanger is a condenser and the second heat exchanger is an evaporator, wherein the first pair of valved connecting pipes to the heating load conduct fluid to and from the condenser, wherein the second pair of valved connecting pipes to the cooling load conduct fluid to and from the evaporator, and wherein the third pair of valved connecting pipes to the source conduct fluid to and from the condenser, wherein the module further comprises a fourth pair of valved connecting pipes for conducting fluid between the source and the evaporator.

9. The heating and cooling module of claim 8 further comprising a first pair of inlet and outlet headers for connecting the first pair of valved connecting pipes to the heating load, a second pair of inlet and outlet headers for connecting the second pair of valved connecting pipes to the cooling load, and a third set of inlet and outlet headers for connecting the third pair of valved connecting pipes to the source.

10. The heating and cooling module of claim 9 wherein each of the headers comprises a coupling for connecting to a header on an adjacent unit.

11. A bank of modules comprising a plurality of heating and cooling modules as defined in claim 9, and wherein the headers in each module are connected end-to-end with corresponding headers in at least one adjacent module in the plurality of modules.

12. An air conditioning system for a structure, the system comprising the bank of modules defined in claim 11.

13. The heating and cooling module of claim 1 further comprising a second compressor.

14. The heating and cooling module of claim 1 further comprising a first pair of inlet and outlet headers for connecting the first pair of valved connecting pipes to the heating load, a second pair of inlet and outlet headers for connecting the second pair of valved connecting pipes to the cooling load, and a third set of inlet and outlet headers for connecting the third pair of valved connecting pipes to the source.

15. The heating and cooling module of claim 1 further comprising a control panel.

16. The heating and cooling module of claim 15 further comprising an electrical box.

17. The heating and cooling module of claim 1 further comprising an electrical box.

18. The heating and cooling module of claim 1 wherein each of the first, second and third pairs of valved connecting pipes comprises a pipe and a valve.

19. The heating and cooling module of claim 18 wherein all the valves are motorized valves.

20. The heating and cooling module of claim 18 wherein each pair of valved connecting pipes includes an inlet pipe and an outlet pipe, and wherein the valve in the valved connecting inlet pipe between the source and the first heat exchanger is a manual shut-off valve, and the valves in the other valved connecting pipes all are motorized valves.

21. A bank of modules comprising a first heating and cooling module as defined in claim 1, and a second module comprising:

a frame; a condenser mounted on the frame;

an evaporator mounted on the frame;

at least one compressor mounted on the frame;

a first pair of valved connecting pipes for conducting fluid between the heating load and condenser; and a second pair of valved connecting pipes for conducting fluid between the cooling load and the evaporator.

22. The bank of modules of claim 21 wherein each of the first and second modules further comprises a first pair of inlet and outlet headers for connecting the first pair of valved connecting pipes to the heating load and a second pair of inlet and outlet headers for connecting the second pair of valved connecting pipes to the cooling load, and wherein the first module further comprises a third set of inlet and outlet headers for connecting the third pair of valved connecting pipes to the source.

* * * * *